US005685491A

United States Patent [19]

Marks et al.

[11] Patent Number: 5,685,491

[45] Date of Patent: Nov. 11, 1997

[54] ELECTROFORMED MULTILAYER SPRAY DIRECTOR AND A PROCESS FOR THE PREPARATION THEREOF

[75] Inventors: Gary T. Marks, Phelps; James H. McVeigh, Webster; Judy A. Sline, Romulus; Kenneth E. Wood, Macedon, all of N.Y.

[73] Assignee: AMTX, Inc., Canandaigua, N.Y.

[21] Appl. No.: 371,118

[22] Filed: Jan. 11, 1995

[51] Int. Cl.[6] ..... F02M 61/00

[52] U.S. Cl. ..... 239/533.12; 239/585.3; 239/596; 205/70; 205/75

[58] Field of Search ..... 239/533.12, 585.3, 239/596, 590.3, 590.5; 205/67, 73, 75, 78, 70

[56] References Cited

U.S. PATENT DOCUMENTS

| | | | |
|---|---|---|---|
| 4,184,925 | 1/1980 | Kenworthy | 205/73 |
| 4,229,265 | 10/1980 | Kenworthy | 204/11 |
| 4,246,076 | 1/1981 | Gardner | 204/11 |
| 4,586,226 | 5/1986 | Fakler et al. | 29/157 R |
| 4,675,083 | 6/1987 | Bearss et al. | 204/11 |
| 4,716,423 | 12/1987 | Chan et al. | 346/140 R |
| 4,826,131 | 5/1989 | Mikkor | 239/585.3 |
| 4,828,184 | 5/1989 | Gardner et al. | 239/590.3 |
| 4,839,001 | 6/1989 | Bakewell | 204/11 |
| 4,902,386 | 2/1990 | Herbert et al. | 204/9 |
| 4,915,983 | 4/1990 | Lake et al. | 427/96 |
| 4,954,225 | 9/1990 | Bakewell | 204/11 |
| 4,972,204 | 11/1990 | Sexton | 346/75 |
| 5,167,776 | 12/1992 | Bhaskar et al. | 205/75 |
| 5,277,783 | 1/1994 | Ohashi et al. | 205/75 |
| 5,359,928 | 11/1994 | Blessington et al. | 101/128.4 |
| 5,383,597 | 1/1995 | Sooriakumar | 239/596 |
| 5,443,713 | 8/1995 | Hindman | 205/75 X |
| 5,449,114 | 9/1995 | Wells et al. | 239/596 |
| 5,492,277 | 2/1996 | Tani et al. | 239/596 |

FOREIGN PATENT DOCUMENTS 0 435 437 A1 7/1991 European Pat. Off. .

OTHER PUBLICATIONS

W. P. Richardson, "The Influence of Upstream Flow Conditions on the Atomizing Performance of a Low Pressure Port Fuel Injector", Thesis for Master of Science in Mechanical Engineering, Michigan Technological University, 1991.

M. Zanini et al., "Silicon Microstructures: Merging Mechanics with Microelectronics", Sensors and Activators, Society of American Engineers, Special Publication No. 903, SAE Paper 920472 (1992).

*Primary Examiner*—Andres Kashnikow
*Assistant Examiner*—Lisa Ann Douglas
*Attorney, Agent, or Firm*—Oliff & Berridge

[57] ABSTRACT

A spray director incorporates structure that generates upstream turbulence for control of spray distribution and spray droplet size. A method of fabricating spray director utilizes a multilayer resist process in conjunction with a multilayer electroforming process.

18 Claims, 5 Drawing Sheets

ELECTROFORMED MULTILAYER SPRAY DIRECTOR AND A PROCESS FOR THE PREPARATION THEREOF

FIELD OF THE INVENTION

The present invention relates to a spray director incorporating upstream turbulence generation for control of spray distribution and spray droplet size. The invention also relates to a method of fabricating a spray director utilizing a multilayer resist process in conjunction with a multilayer electroforming process.

BACKGROUND

Spray directors or nozzles with small, precision orifices are employed in numerous industrial applications, including, for example, use as fuel injectors in internal combustion automotive engines and rocket engines, as thermal ink jet printheads, and in similar services requiring the precise metering of a fluid.

Conventional methods of fabricating nozzles include casting from a mold, machining, and electroplating, and may require a finishing step to produce the final nozzle.

Electroplating methods of fabricating nozzles employ various combinations of dry and liquid resists, and etching. Such methods are limited, however, in that the maximum electroformed layer thickness achievable is approximately 100 microns.

Prior art methods of fabricating nozzles have generally suffered from a lack of precision in orifice generation. Until now, such methods have comprised joining discrete components to form nozzles.

For example, William P. Richardson, Michigan Technological University Master's Thesis: "The Influence of Upstream Flow Conditions on the Atomizing Performance of a Low Pressure Fuel Injector" (1991), discloses nozzles produced through the process of Silicon MicroMachining (SMM). In this process, orifice configuration is provided by silicon etching.

U.S. Pat. No. 4,586,226 to Fakler et al. relates to a method of fabricating a small orifice fuel injector using a wax and silver technique followed by post-finishing. A first layer of Ni is electrodeposited on a stainless steel base plate in which fuel feed passages are formed. Connecting bores to the perforations are made through a face plate Ni layer. Plastic mandrels are fabricated having legs with support sections, orifice forming sections and coupling tabs for tying the legs together. The support sections of the mandrels are set into acceptor holes formed in the face plate and a bonded layer of rigid material is built up by electrodeposition to enclose the orifice forming sections. The sections of the mandrels extending outside the bonded layer are removed and the surface is smoothly finished.

U.S. Pat. No. 4,246,076 to Gardner relates to a multilayer dry film plating method for fabricating nozzles for ink jet printers. The process comprises the steps of coating a first layer of a photopolymerizable material on a substrate, and exposing the layer to a pattern of radiation until at least a portion of the layer of photo-polymerizable material polymerizes. A free surface of the first layer is coated with a second layer of a photo-polymerizable material, the process being analogous to the process associated with the deposition of the first layer. Both the layers are developed to remove non-polymerized material from the substrate followed by metallic deposition on the substrate by electroplating.

U.S. Pat. No. 4,229,265 to Kenworthy discloses a thick dry film resist plating technique for fabricating an orifice plate for a jet drop recorder. A sheet of stainless steel is coated on both sides with a photoresist material. The photoresist is then exposed through suitable masks and developed to form cylindrical photoresist peg areas on both sides of the sheet. Nickel is then plated on the sheet until the height thereof covers the peg edges. A larger diameter photoresist plug is then formed over each photoresist peg. Nickel plating is then continued until the height is level with the plug. The photoresist and plate are then dissolved and peeled from the nickel forming two solid homogeneous orifice plates.

U.S. Pat. No. 4,675,083 to Bearss et al. relates to a method of manufacturing metal nozzle plates associated with an ink jet printhead by using a two-step resist and plating process. The method comprises the steps of providing a first mask on a metal substrate that includes a first plurality of mask segments and providing a second mask including a second plurality of segments formed atop the first plurality of segments. This structure is then transferred to an electroforming station wherein a layer of nickel is formed on exposed surfaces up to a thickness of about 2.5 mils. Once the plate is completed to a desired thickness, negative and positive photoresist mask segments are removed using conventional photoresist liftoff processes.

U.S. Pat. No. 4,954,225 to Bakewell relates to a method for electroforming nozzle plates having three-dimensional features. The method employs a dry film over liquid, and a thick film photoresist. A conductive coating is applied to the surface of a transparent mandrel using photolithographic techniques. A pattern of thin, circular masked areas of a non-conductive, transparent material is formed over each hole formed in the opaque, conductive coating. A layer of first metal is plated onto the conductive coating on the transparent mandrel. A layer of second metal is plated over the first metal layer until the first layer of the second metal surrounds, but does not cover the photoresist posts. Depressions caused in the metal layers are filled with fillers to create smooth continuous surface on the top of the plate layers. A thick layer of photoresist is then applied over the top of the smooth plated layers and cured so as to form a pattern of thick photoresist discs covering and in registration with the filled depressions. The plated layers are then separated from the transparent mandrel and the extraneous material is stripped using suitable stripping techniques.

U.S. Pat. No. 4,839,001 to Bakewell relates to a method of fabrication of an orifice plate using a thick film photoresist in which the plate is constructed from two electroformed layers of nickel. A first layer of Ni is electroformed onto a conductive mandrel to form a support layer with a selected hole pattern. Copper is plated over the Ni to cover the holes. A second layer of Ni is electroformed onto the surface that is joined to the mandrel in such a way as to form an orifice layer with a pattern of smaller holes of selected cross section in alignment with the pattern of holes of the first nickel layer. The copper is then etched away to reveal a thin orifice plate of Ni.

U.S. Pat. No. 4,716,423 to Chan et al. relates to a process employing the application of a first liquid and then a dry film for the manufacture of an integrated orifice plate. The process consists of forming a first mask portion having a convergently contoured external surface and a second mask portion having straight vertical walls. A first metal layer is electroformed around the first mask portion to define an orifice plate layer and electroforming of the second metal layer is done around the second mask portion to define a barrier layer of discontinuous and scalloped wall portions having one or more ink reservoir cavities. Finally, the first and second masks and selected portions of metallic substrate are removed, thereby leaving intact the first and second metal layers in a composite configuration.

U.S. Pat. No. 4,902,386 to Herbert et al. relates to a cylindrical electroforming mandrel and a thick film photoresist method of fabricating and using the same.

U.S. Pat. No. 5,167,776 to Bhaskar et al. discloses an orifice or nozzle plate for an ink jet printer that may be produced by a process comprising providing electroplating over the conductive regions and over a portion of the insulating regions of a mandrel to form a first electroformed layer having convergent orifice openings corresponding to the insulating regions. The electroplating process may be repeated once to form a second electroformed layer on the first electroformed layer, said second layer having convergent orifice openings aligned with those of the first layer.

U.S. Pat. No. 4,972,204 to Sexton discloses an orifice plate for an ink jet printer produced by a multilayer electroforming process comprising the steps of forming resist pegs on a substrate and electroplating onto said substrate a first metal layer complementary to said resist pegs, allowing the metal to slightly overgrow the top surface of the resist pegs and form a first electroformed layer. A first resist layer in the form of a channel wider than the resist pegs is placed on the resist pegs and the first electroformed layer. A second electroformed layer is formed around the first resist layer and on the first electroformed layer. A series of resist layers of ever-increasing width and electroformed layers of ever-decreasing width are subsequently layered onto the nascent orifice plate in like fashion to eventually form an orifice plate having orifices opening into a channel that progressively widens upstream from the orifices.

The above references are incorporated herein by reference in their entireties.

SUMMARY OF THE INVENTION

Embodiments of the present invention are directed to a multilayered fluid dispersant spray director incorporating structure producing upstream turbulence generation for control of spray distribution and spray droplet size.

Methods of fabricating such a spray director are also disclosed.

One method provides for the fabrication of a spray director using a multilayer resist process in conjunction with a multilayer electroforming process. A pattern of resist complementary to a pattern of the cross section of the spray director is applied to a conductive substrate, followed by the electroforming of a patterned layer onto the substrate. The resist application process and electroforming process are repeated a plurality of times to produce a multilayered electroformed spray director.

A resulting structure of the spray director includes multiple electroformed layers in which at least one fluid entry orifice is formed in at least one base layer of the multiple electroformed layers, at least one fluid ejection orifice is formed in at least one top layer of the multiple electroformed layers, and a turbulence-inducing channel connects said at least one entry orifice with said at least one ejection orifice. The turbulence-inducing channel is arranged such that it causes the direction of the fluid entering through the at least one entry orifice to change prior to being ejected from the at least one ejection orifice. That is, the turbulence-inducing channel conveys fluid from the at least one entry orifice to the at least one ejection orifice in a nonlinear manner.

According to one preferred embodiment, the turbulence-inducing channel is formed in an intermediate multiple electroformed layer, which is positioned between the base and top electroformed layers. In this preferred embodiment, the entry orifice and the at least one ejection orifice are laterally offset from each other (i.e., offset in a direction perpendicular to the direction in which the central axes of the entry and ejection orifices extend), and the turbulence-inducing channel extends in the direction perpendicular to the axes of the orifices. Thus, in this embodiment, the fluid enters the entry orifice flowing in a direction parallel to the entry orifice axis, enters the turbulence-inducing channel where the flow direction changes by approximately 90°, flows through the turbulence-inducing channel to the at least one ejection orifice, and changes direction again by approximately 90° upon being ejected through the at least one ejection orifice.

This type of flow path creates turbulence in the fluid, which improves the atomization and spray distribution of the ejected fluid.

Other features and advantages of embodiments of the present invention will become more fully apparent from the following detailed description of preferred embodiments, the appended claims, and the accompanying drawings.

BRIEF DESCRIPTION OF THE DRAWINGS

The invention will be described in conjunction with the following drawings in which like reference numerals designate like elements and wherein.

DETAILED DESCRIPTION OF PREFERRED EMBODIMENTS

Figure 1A:
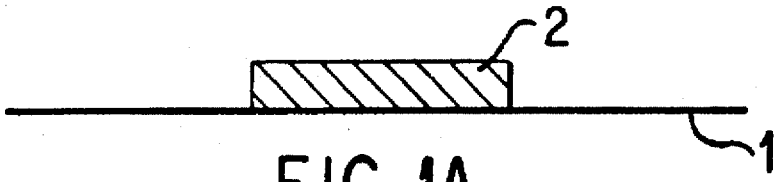
FIGS. 1A through 1I are cross-sectional views illustrating stages of the production of a fluid dispersant spray director having a turbulence inducing fluid path, in accordance with an embodiment of the invention.

An embodiment of the method according to the invention provides for electroforming multiple layers of metal, with each layer ranging from about 0.010 mm to about 0.400 mm in thickness, and eliminates the requirement of any additional finishing step. The method produces smooth, planar, and flat surfaces. No lapping, grinding, forming, or machining is necessary to obtain flatness and planarity. The method produces a spray director with orifice dimensions and fluid pathway characteristics desirable for applications requiring the precise metering of a fluid, such as, for example, a fuel injector nozzle. The turbulence-inducing channel improves atomization and fluid distribution of the ejected fluid, which is particularly advantageous for fuel injection nozzles. The invention, however, is not limited to fuel injection nozzles. The invention also can be used in, for example, paint spray applications, cosmetic spray applications, household or industrial cleaner dispensing applications, or any other applications in which fluid atomization and spray pattern control are desired.

A pattern of resist, which is complementary to a desired spray director cross section, is prepared for the electroforming process with an appropriate phototool design. Phototool designs are commonly used in the art.

For example, a line drawing in the nature of a design for a nozzle cross section is made on a piece of paper such that dark lines correspond to the final design desired to be imprinted. The lines are separated by non-image bearing areas. A positive or negative phototool of the original artwork is prepared using conventional photographic processes. The phototool for a negative resist has clear lines corresponding to the lines of the original artwork and darkened areas corresponding to the areas between the lines. As is known by those of skill in the art, a phototool used for a positive resist would have these areas reversed, i.e., the lines would be dark and the areas between the lines would be clear.

A conductive substrate is first cleaned by methods well known to those of skill in the art to prepare it for the application of a pattern of resist. The sequence of cleaning steps can include washing with isopropyl alcohol, vapor degreasing in trichloroethylene, electrocleaning, rinsing in distilled water, washing in nitric acid, and final rinsing in distilled water. Typical substrate materials include stainless steel, iron plated with chromium or nickel, nickel, copper, titanium, aluminum, aluminum plated with chromium or nickel, titanium palladium alloys, nickel-copper alloys such as Inconel® 600 and Invare® (available from Inco), and the like. Non-metallic substrates can also be used if they have been made conductive, for example, by being appropriately metallized using metallization techniques known to the art, such as electroless metallization, vapor deposition, and the like.

The substrate can be of any suitable shape. If cylindrical, the surface of the substrate should be substantially parallel to the axis of the substrate.

The resist materials can include various types of liquid resists. As is well known in the art, these resist materials can be classified as either positive, such as Microposit® or Photoposit®, obtainable from Shipley, Inc. (Newton, Mass.) or negative, such as Waycoat Resists obtainable from OGC Microelectronics, Inc. These liquid resists are either aqueous processible or solvent processible in commonly employed organic solvents such as benzene, dichloromethane, trichloroethane, and the like. The positive resist materials include solvent processible resists containing 2-ethoxyethyl acetate, n-butyl acetate, xylene, o-chlorotoluene, toluene, blends of novolak resins, and photoactive compounds. The negative resist materials include solvent processible resists containing cyclized polyisoprene and diazido photoinitiators.

In the case of a negative resist, for example, the phototool is tightly secured to the surface of the resist coated substrate. The substrate is irradiated with actinic radiation at an energy level of 100–200 $mJ/cm^2$ to 100–2,000 $mJ/cm^2$, for example. The phototool is removed leaving those portions of the resist that were exposed to the UV radiation polymerized and those portions of the resist that were not irradiated still in semi-solid form. The resist layer is developed on the substrate with conventional developing equipment and chemistry. Those portions of the resist that were not irradiated are washed away in the development process, leaving only the polymerized portions remaining on the surface of the substrate. In the case of positive resist systems, irradiated areas are washed away and non-irradiated areas remain after the development process.

Figure 1B:
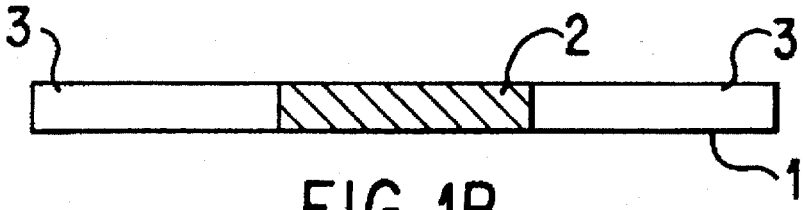

Throughout the FIGS., like numbers represent like parts. As depicted in FIGS. 1A and 1B, a first patterned layer 3 is electroformed on the substrate 1 bearing a first resist pattern 2. The shapes of the first patterned layer 3 and first resist pattern 2 may be selected from any shapes that produce a desired effect on the particle size and/or the directionality of the spray. Exemplary shapes include those that are circular, oblong, egg-shaped, toroid, cylindrical, polygonal, triangular, rectangular, square, regular and irregular.

The electroforming process takes place within an electroforming zone comprising an anode, a cathode, and an electroforming bath. The bath may be composed of: ions or salts of ions of the patterned layer-forming material, the concentration of which can range from trace to saturation, which ions can be in the form of anions or cations; a solvent; a buffering agent, the concentration of which can range from zero to saturation; an anode corrosion agent, the concentration of which can range from zero to saturation; and, optionally, grain refiners, levelers, catalysts, surfactants, and other additives known in the art. The preferred concentration ranges may readily be established by those of skill in the art without undue experimentation. A preferred electroforming bath to plate nickel (i.e., as the first patterned layer 3) on a substrate comprises about 80 mg/ml of nickel ion in solution, about 20–40 mg/ml of $H_3BO_3$, about 3.0 mg/ml of $NiCl_2 \cdot 6H_2O$ and about 4.0–6.0 ml/liter of sodium lauryl sulfate. Other suitable electroforming bath compositions include, but are not limited to, Watts nickel: about 68–88 mg/ml of nickel ion, about 50–70 mg/ml of $NiCl_2 \cdot 6H_2O$ and about 20–40 mg/ml of $H_3BO_3$; chloride sulfate: about 70–100 mg/ml of nickel ion, about 145–170 mg/ml of $NiCl_2 \cdot 6H_2O$ and about 30–45 mg/ml $H_3BO_3$; and concentrated sulfamate: about 100–120 mg/ml of nickel ion, about 3–10 mg/ml of $NiCl_2 \cdot 6H_2O$ and about 30–45 mg/ml of $H_3BO_3$. Electroless baths such as electroless nickel baths can also be employed. Various types are available depending upon the properties required in the electroform deposition. These electroless baths are well known to those skilled in the art.

Examples of metals that can be electroformed onto the surface of a substrate include, but are not limited to, nickel, copper, gold, silver, palladium, tin, lead, chromium, zinc, cobalt, iron, and alloys thereof. Preferred metals are nickel and copper. Any suitable conductor or material that can be electrochemically deposited can be used, such as conductive polymers, plastics, and electroless nickel deposits. Examples of suitable autocatalytic electroless nickel deposits include, but are not limited to, nickel-phosphorus, nickel-boron, poly-alloys, such as copper-nickel phosphorus, nickel-polytetrafluoroethylene, composite coatings, and the like. Methods of preparing electroless nickel deposits employed within the scope of this invention are well known to those skilled in the art of electroforming.

The electrolytic bath is energized using a suitable electrical source. Patterned layer-forming ions from the solution are electroformed on the exposed conductive surfaces of the substrate 1 determined by the pattern of polymerized resist 2. Those portions of the substrate covered with the resist remain unplated. The process is allowed to proceed until a first patterned layer 3 has deposited on the exposed surface of the substrate 1 to a desired thickness ranging from about 0.010 mm to about 0.400 mm, and preferably ranging from about 0.020 mm to about 0.200 mm. As depicted in the FIGS., this thickness can correspond to the thickness of the first resist pattern 2. Thus, the ranges of suitable thicknesses for the first resist pattern 2 are about the same as those for the first patterned layer 3.

Figure 1C:
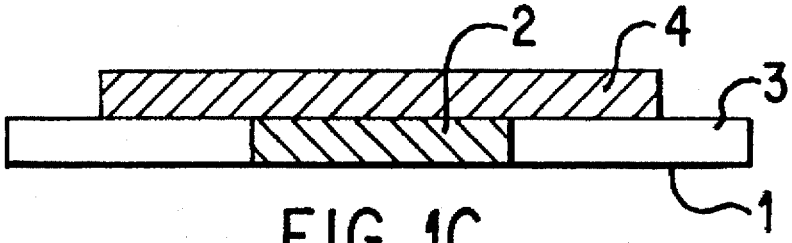
Figure 1D:
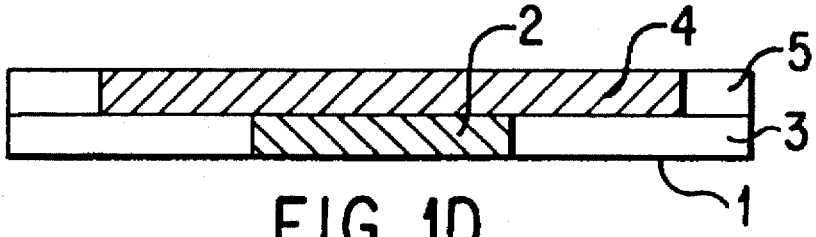

FIGS. 1C and 1D depict another cycle of resist application and electroplating. A second resist pattern 4 is provided on top of the first resist pattern 2 and over part of the first patterned layer 3. The electrolytic bath is energized and patterned layer-forming ions from the solution are electroformed on the exposed conductive surfaces of the first patterned layer 3 in a pattern complementary to the second resist pattern 4. The process is continued until a second patterned layer 5 is deposited on the exposed surface of the first patterned layer 3 to a desired thickness ranging from about 0.010 mm to about 0.400 mm, and preferably ranging from about 0.020 mm to about 0.200 mm. As depicted in the FIGS., this thickness can correspond to the thickness of the second resist pattern 4. Thus, the ranges of suitable thicknesses for the second resist pattern 4 are about the same as those for the second patterned layer 5.

The shapes of the second patterned layer 5 and second resist pattern 4 may be selected from any shapes that produce a desired effect on the particle size and/or the directionality of the spray. Exemplary shapes include those that are circular, oblong, egg-shaped, toroid, cylindrical, polygonal, triangular, rectangular, square, regular and irregular.

Figure 1E:
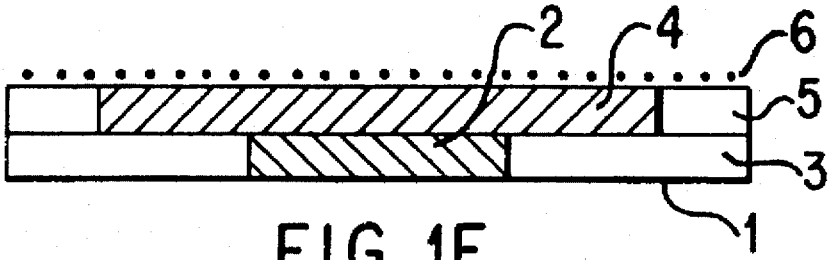

FIG. 1E depicts a metallizing step in which a metallic layer 6 is coated on top of the second resist pattern 4 and the second patterned layer 5. The metallic layer 6 can be applied by any of the numerous metallization techniques known to those of ordinary skill in the art, such as, e.g., evaporative Physical Vapor Deposition (PVD), sputtering PVD and autocatalytic electroless deposition. Suitable components of the metallic layer 6 include, but are not limited to, Au, Ag, Ni, Pd, Ti, Fe, Cu, Al and Cu, Al and Cr. The thickness of the metallic layer should be 0.00001 mm to 0.020 mm, preferably 0.00005 mm to 0.005 mm. The metallic layer is provided to enable electroforming to take place over the non-conductive second resist pattern 4.

FIGS. 1F–1G and FIGS. 1H–1I depict alternative further steps according to different embodiments of the invention.

Figure 1F:
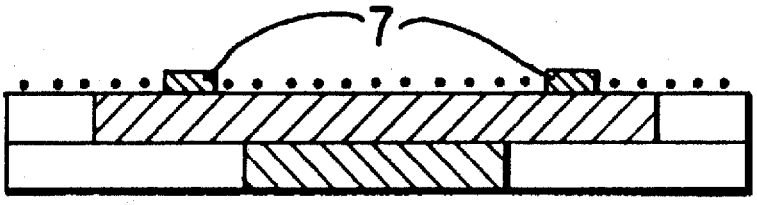
Figure 1G:
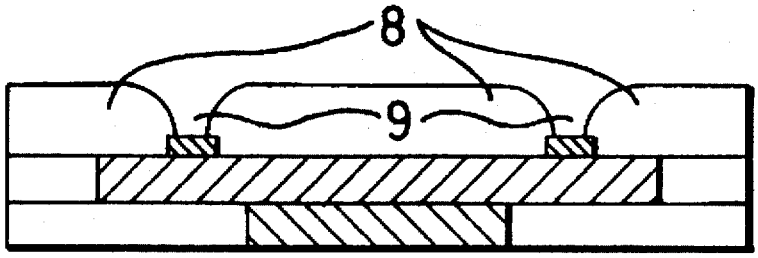

FIGS. 1F and 1G depict providing third resist patterns 7, and electroplating a third patterned layer 8 on top of the metallic layer 6. The resulting third patterned layer 8 is characterized as having an overgrowth geometry. In a layer having this geometry, electroplated material overlaps edges of each third resist pattern 7 to define a graduated fluid ejection orifice 9. This type of geometry occurs when the resist material is a liquid resist and/or the third resist patterns 7 are thin relative to the third patterned layer 8. The height of the third resist patterns 7 should be 0.0005 mm to 0.100 mm, preferably 0.001 mm to 0.075 mm, more preferably 0.002 mm to 0.050 mm.

Resist materials that can be employed to form overgrowth geometry include, but are not limited to, those liquid resists typically containing 2-ethoxyethyl acetate, n-butyl acetate, xylene, o-chlorotoluene, toluene, and photoactive compounds and blends of photoactive compounds. Examples of photoactive compounds include, but are not limited to, diazo-based compounds or diazodi-based compounds.

The shapes of the third patterned layer 8 and the third resist patterns 7 may be selected from any shapes that produce a desired effect on the particle size and/or the directionality of the spray. Exemplary shapes include those that are circular, oblong, egg-shaped, toroid, cylindrical, polygonal, triangular, rectangular, square, regular and irregular. In a preferred embodiment of the invention, the third resist patterns have shapes with at least one sharp edge.

Figure 1H:
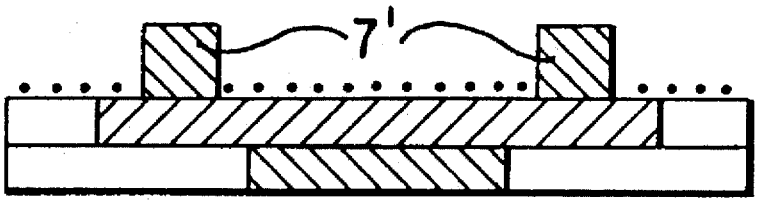
Figure 1I:
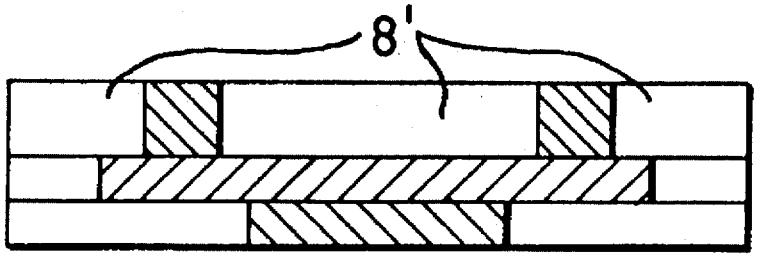

FIGS. 1H and 1I depict providing third resist patterns 7' having a thickness at least sufficient to substantially prevent overgrowth geometry, such as that depicted in FIG. 1G. In this embodiment, the third patterned layer 8' is electroplated on top of the metallic layer 6 to a height less than or equal to that of the third resist patterns 7'. When the third patterned layer 8' is intended to have a thickness that is less than the third resist patterns 7', the target thickness for the third patterned layer 8' is preferably about 10% less than the thickness of the third resist patterns 7'. The height of the third resist patterns 7' and the third patterned layer 8' should be 0.010 mm to 0.400 mm, preferably 0.025 mm to 0.300 mm, more preferably 0.050 mm to 0.250 mm. The top surfaces of the third resist patterns 7' are substantially free of electroplating.

After the desired multilayer thickness is electroformed on the surface of the substrate 1, the substrate is removed from the solution. The multilayer electroformed pattern can be removed from the surface of the substrate by standard methods that include, but are not limited to, mechanical separation, thermal shock, mandrel dissolution, and the like. These methods are well known to those of skill in the electroforming art.

The resist patterns and the portion of metallic layer present in the flow path are preferably removed before removing the substrate to minimize parts handling. The resist patterns can be removed by any suitable method practiced in the art. Such methods include washing the substrate in acetone or dichloromethane for solvent processible resists, or blends of ethanolamine and glycol ethers for aqueous processible resists. Other suitable methods of removing photoresist are known in the art and are typically provided by suppliers of photoresist material.

The metallic layer in the flow path is preferably removed by the resist cleaning media in the resist removal step. However, if the metallic layer in the flow path remains after resist removal, it can be removed by selective chemical etching techniques well known to those of ordinary skill in the art.

In multiple layer structures, such as the three layer structures depicted in the FIGS., a post-substrate removal cleaning step is usually necessary. Typically, this step can be accomplished by tumbling the parts in, e.g., acetone, dichloromethane, or blends of ethanolamine and glycol esters.

Although FIGS. 1A to 1I depict embodiments in which the resist pattern and patterned layer defining the entry orifice are the first applications to the substrate, those of ordinary skill in the art will readily appreciate that the process could be reversed, such that the resist patterns and patterned layer defining the ejection orifices would be the first applications to the substrate (i.e., the base layer), and the resist pattern and patterned layer defining the entry orifice would be the last applications to the nascent spray director (i.e., the top layer). An example of such an alternative embodiment comprises: applying onto a conductive substrate a first resist pattern having a shape corresponding to a shape of at least one fluid ejection orifice; electroforming onto the conductive substrate a first patterned layer complementary to the first resist pattern; applying onto a first surface defined by the first patterned layer and the first resist pattern a second resist pattern having a shape corresponding to a shape of an intermediate channel; electroforming onto the first surface a second patterned layer complementary to the second resist pattern; applying a metallic layer onto a second surface defined by the second resist pattern and the second patterned layer; applying onto the metallic layer a third resist pattern having a shape corresponding to the shape of an entry orifice; electroforming onto the metallic layer a third patterned layer complementary to the third resist pattern, to provide a multilayered electroformed pattern; removing the resist patterns and a portion of the metallic layer located in a nonlinear fluid pathway from the multilayered electroformed pattern; and removing the multilayered electroformed pattern from the substrate to provide a fluid dispersant unit.

Figure 2A:
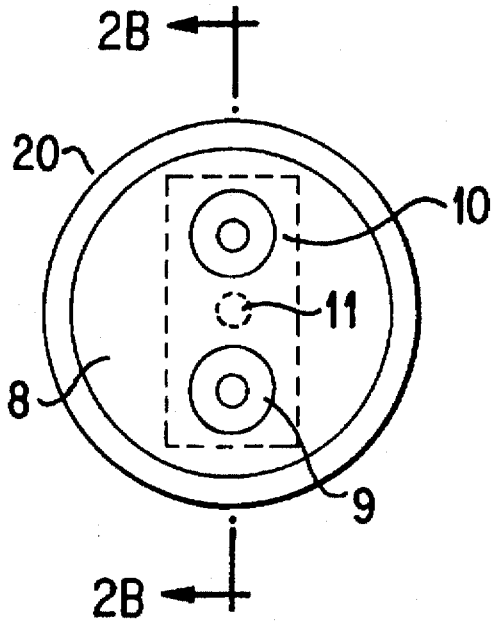
FIG. 2A is a front view of a fluid dispersant spray director, in accordance with an embodiment of the invention.
Figure 2B:
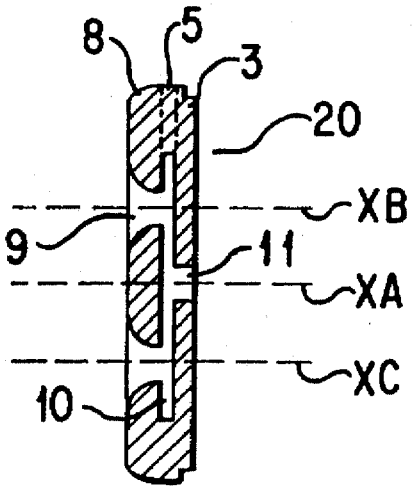
FIG. 2B is a cross-sectional view through line 2B—2B of FIG. 2A.
Figure 3A:
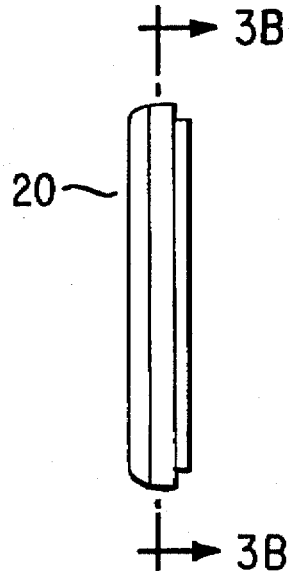
FIG. 3A is a side view of a fluid dispersant spray director, in accordance with an embodiment of the invention.
Figure 3B:
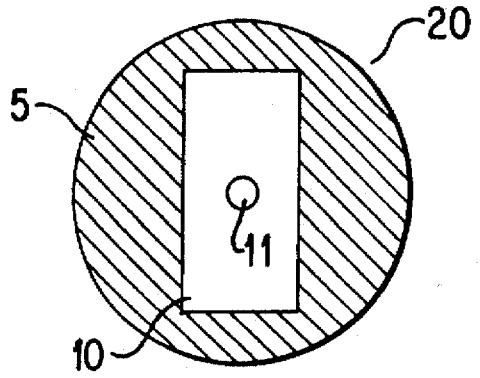
FIG. 3B is a cross-sectional view through line 3B—3B of FIG. 3A.

FIGS. 2A–2B and 3A–3B depict a preferred embodiment of a completed spray director 20 after the substrate and photoresist material have been removed. Referring to FIG. 2B, an entry orifice 11 has a central axis XA extending in a first direction. The fluid ejection orifices 9 have central axes XB and XC parallel to, but offset from entry orifice axis XA.

A fluid to be dispersed flows into the fluid dispersant spray director 20 through the entry orifice 11 and into an intermediate channel 10. An internal of the third patterned layer 8 interrupts the linear flow of the fluid, forcing the fluid to undergo n turbulence inducing angular fluid path transition prior to exiting the intermediate channel 10 and spraying through two fluid ejection orifices 9. In the illustrated embodiment, channel 10 extends in a direction substantially perpendicular to the orifice axes XA, XB and XC.

Figure 4A:
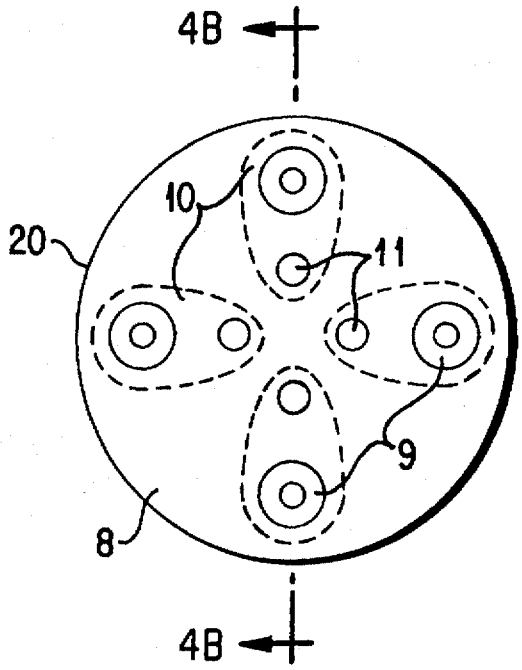
FIG. 4A is a front view of a fluid dispersant spray director, in accordance with an embodiment of the invention.
Figure 4B:
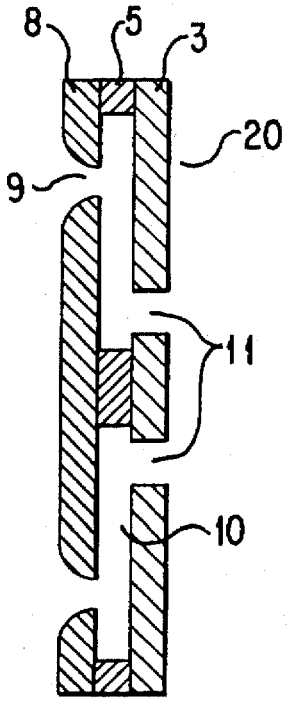
FIG. 4B is a cross-sectional view through line 4B—4B of FIG. 4A.

FIGS. 4A–4B depict another preferred embodiment a completed spray director 20. In this embodiment, there are four each of the entry orifice 11, intermediate channel 10 and the fluid ejection orifice 9. Each intermediate channel 10 has an egg-shaped cross-section.

Advantageously, a spray director prepared according to the invention can have a range of cross-sectional diameters and thicknesses. For example, the fluid ejection orifices of a spray director can have a minimum cross-section dimension from about 0.010 mm to about 2.00 mm preferably from about 0.020 mm to about 0.500 mm. The dimensions of the fluid ejection orifice 9 are driven by fluid flow requirements and vary widely depending on the application and pressure drop requirement actual spray director. Theme dimensions may be determined by one of ordinary skill in the art without undue experimentation.

The dimensions of the photoresist on the substrate and electroformed layers, and the electroforming time, determine the dimensions of the spray director. The multilayer thickness of the spray director should be about 0.100 mm to about 1.500 mm. A preferred thickness ranges from about 0.300 mm to about 0.900 mm. Variations from these exemplary ranges may therefore readily be made by those of skill in the art.

More than one entry orifice 11 can be provided in each spray director 20. One fluid ejection orifice 9 can be provided in each spray director 20. Alternatively, two (as shown) or three or more fluid ejection orifices 9 can be provided in each spray director 20.

The number of patterned layers in a spray director is not limited to three. More than three patterned layers can be provided, for example, to facilitate the formation of more intricate cavities, orifices, flow paths, and the like. For example, additional layers may be provided to facilitate the formation of grooves, fins or ribs on the downstream wall of the intermediate channel, which structures further impact fluid turbulence.

The axes of the entry and ejection orifice need not be parallel, and need not be perpendicular to the intermediate channel, as long as sufficient turbulence is generated in the fluid.

A plurality of spray directors may be simultaneously fabricated on a single substrate. To allow the parts to be removed from the substrate as a continuous sheet and to facilitate handling of the array, thin coupling strips may be electroformed to affix the final electroformed layer of each spray director pattern to at least one other of the spray director patterns. The distance between the spray directors in the array pattern may vary widely, with the goal being to minimize the space.

Spray directors prepared according to the present invention can be employed in applications requiring spray directors with precision orifices, such as the precise metering of a fluid. Such uses include, but are not limited to, fuel injector nozzles for use in internal combustion engines, printing nozzles for thermal ink jet printing, drop on demand printing and piezoelectric drive printing, and spray applications, including epoxy sprays, paint sprays, adhesive sprays, cosmetic sprays, household or industrial cleaner sprays and solder paste sprays, or any other applications in which fluid atomization and spray pattern control are desired.

While the invention has been described in detail and with reference to specific embodiments thereof, it will be apparent to those of ordinary skill in the art that various changes and modifications can be made therein without departing from the spirit and scope thereof.

What is claimed is:

1. A fluid dispersant unit consisting essentially of:

a plurality of electroformed layers and at least one metallic layer between at least one adjacent pair of said plurality of layers, said layers defining a nonlinear fluid pathway comprising an entry orifice for receiving a fluid; a fluid ejection orifice for ejecting said fluid; and a turbulence inducing intermediate channel between said entry orifice and said fluid ejection orifice for nonlinearly conveying said fluid from said entry orifice to said fluid ejection orifice.

2. The fluid dispersant unit according to claim 1, wherein said turbulence inducing intermediate channel is defined by an upstream wall and a downstream wall, said upstream wall penetrated by said entry orifice, and said downstream wall penetrated by said fluid ejection orifice at a location offset from said entry orifice.

3. The fluid dispersant unit according to claim 2, wherein said turbulence inducing intermediate channel has a cross-section that is rectangular or egg-shaped.

4. The fluid dispersant unit according to claim 2, wherein said turbulence inducing intermediate channel extends in a direction that is substantially perpendicular to a central axis of at least one of said fluid ejection orifice and said entry orifice.

5. The fluid dispersant unit according to claim 1, having four each of said entry orifice, said fluid ejection orifice and said turbulence inducing intermediate channel.

6. The fluid dispersant unit according to claim 1, comprising two fluid ejection orifices in fluid communication with said turbulence inducing intermediate channel.

7. The fluid dispersant unit according to claim 1, wherein said fluid ejection orifice is defined by at least one electroformed layer having overgrowth geometry.

8. The fluid dispersant unit according to claim 1, wherein said fluid ejection orifice has a shape with at least one sharp edge.

9. The fluid dispersant unit according to claim 1, wherein said entry orifice has a cross-sectional shape selected from the group consisting of circular, oblong, toroid, polygonal, triangular, rectangular and irregular.

10. The fluid dispersant unit according to claim 1, wherein said electroformed layers comprise at least one member selected from the group consisting of nickel, copper, gold, silver, palladium, tin, lead, cobalt, chromium, iron, zinc, and alloys thereof.

11. The fluid dispersant unit according to claim 1, wherein said electroformed layers comprise at least one member selected from the group consisting of nickel-phosphorus, nickel-boron, copper-nickel phosphorus, nickel-polytetrafluoroethylene, and composites thereof.

12. The fluid dispersant unit according to claim 1, wherein said electroformed layers are compositionally identical.

13. The fluid dispersant unit according to claim 1, wherein said fluid dispersant unit is a liquid fuel atomizing injector nozzle for an engine.

14. A method of producing the fluid dispersant unit according to claim 1, said method comprising:

(a) electroforming onto a substrate at least one base patterned layer to define said entry orifice or fluid ejection orifice;

(b) electroforming onto said at least one base patterned layer at least one intermediate patterned layer to define said intermediate channel;

(c) electroforming onto said at least one intermediate patterned layer at least one top patterned layer to define the other said orifice and to provide a multilayered electroformed pattern; and (d) separating said multilayered electroformed pattern from said substrate to provide said fluid dispersant unit.

15. A method of producing the fluid dispersant unit according to claim 1, said method comprising:

(a) applying onto a conductive substrate a first resist pattern having a shape corresponding to a shape of said entry orifice;

(b) electroforming onto said conductive substrate a first patterned layer complementary to said first resist pattern;

(c) applying onto a first surface defined by said first patterned layer and said first resist pattern a second resist pattern having a shape corresponding to a shape of said intermediate channel;

(d) electroforming onto said first surface a second patterned layer complementary to said second resist pattern;

(e) applying a metallic layer onto a second surface defined by said second resist pattern and said second patterned layer;

(f) applying onto said metallic layer a third resist pattern having a shape corresponding to a shape of said fluid ejection orifice;

(g) electroforming onto said metallic layer a third patterned layer complementary to said third resist pattern, to provide a multilayered electroformed pattern;

(h) removing said resist patterns and a portion of said metallic layer located in said nonlinear fluid pathway from said multilayered electroformed pattern; and (i) removing said multilayered electroformed pattern from said substrate to provide said fluid dispersant unit.

16. A method of producing the fluid dispersant unit according to claim 1, said method comprising:

(a) applying onto a conductive substrate a first resist pattern having a shape corresponding to a shape of said fluid ejection orifice;

(b) electroforming onto said conductive substrate a first patterned layer complementary to said first resist pattern;

(c) applying onto a first surface defined by said first patterned layer and said first resist pattern a second resist pattern having a shape corresponding to a shape of said intermediate channel;

(d) electroforming onto said first surface a second patterned layer complementary to said second resist pattern;

(e) applying a metallic layer onto a surface defined by said second resist pattern and said second patterned layer;

(f) applying onto said metallic layer a third resist pattern having a shape corresponding to a shape of said entry orifice;

(g) electroforming onto said metallic layer a third patterned layer complementary to said third resist pattern, to provide a multilayered electroformed pattern;

(h) removing said resist patterns and a portion of said metallic layer located in said nonlinear fluid pathway from said multilayered electroformed pattern; and (i) removing said multilayered electroformed pattern from said substrate to provide said fluid dispersant unit.

17. A fluid dispersant unit consisting essentially of:

a first electroformed layer having at least one entry orifice therein;

a second electroformed layer having at least one fluid ejection orifice therein;

a metallic layer between said first and said second layer; and at least one turbulence-inducing channel extending between said at least one entry orifice and said at least one fluid ejection orifice, said at least one turbulence-inducing channel extending in a direction that is at a non-zero angle to a central axis of at least one of said at lest one entry orifice and said t least one fluid ejection orifice to induce turbulence in liquid flowing from said at least one entry orifice to said at lest one ejection orifice.

18. The fluid dispersant unit according to claim 17, further comprising an intermediate electroformed layer located between said first electroformed layer and said second electroformed layer, said at least one turbulence-inducing channel located in said intermediate electroformed layer.

* * * * *